US005847368A

United States Patent [19]

Sugiyama

[11] Patent Number: 5,847,368

[45] Date of Patent: Dec. 8, 1998

[54] ELECTRIC HEATING UNIT AND METHOD OF PRODUCING SAME

[75] Inventor: Yasuo Sugiyama, Kashiwara, Japan

[73] Assignee: Koyo Lindberg Limited, Kashiwara, Japan

[21] Appl. No.: 667,148

[22] Filed: Jun. 20, 1996

[51] Int. Cl.[6] ..... H05B 1/00; H05B 3/44; H05B 3/00; H01C 1/034

[52] U.S. Cl. ..... 219/544; 219/213; 338/275; 29/611

[58] Field of Search ..... 219/542, 544, 219/546, 547, 548, 213, 406, 407; 338/275, 285; 29/611, 848

[56] References Cited

U.S. PATENT DOCUMENTS

| | | | |
|---|---|---|---|
| 4,292,500 | 9/1981 | Semanaz et al. | 219/213 |
| 4,321,459 | 3/1982 | Miyahara et al. | 219/213 |
| 4,617,450 | 10/1986 | Boes et al. | 219/544 |
| 4,669,181 | 6/1987 | Porzky | 29/611 |
| 4,719,336 | 1/1988 | Sterward | 219/544 |
| 5,126,535 | 6/1992 | Porzky | 219/544 |
| 5,278,939 | 1/1994 | Boes et al. | 219/544 |

FOREIGN PATENT DOCUMENTS 60-243992 12/1985 Japan .

2-89300 7/1990 Japan .

*Primary Examiner*—Teresa J. Walberg
*Assistant Examiner*—Sam Paik
*Attorney, Agent, or Firm*—Reid & Priest LLP

[57] ABSTRACT

An electric heating unit comprises a heat-insulating main body consisting primarily of a heat-insulating material and formed with a groove in a surface thereof, and a heating element provided in the groove and shaped in the form of waves with an amplitude greater than the width of the groove, the heating element having at widthwise opposite sides thereof bent portions extending into the main body from groove-defining opposite side walls thereof and thereby integrally supported by the main body. A bottom-forming member of refractory material made separately from the main body covers the bottom of the groove and is supported by the main body integrally therewith so that the surface of the member toward the opening of the groove is exposed from the main body. The heating element is disposed closer to the groove opening than the bottom-forming member and integrally supported by the main body so as to be in contact with portions of the surface of the member. The heating element is positioned within the groove and exposed outside the main body.

13 Claims, 10 Drawing Sheets

ELECTRIC HEATING UNIT AND METHOD OF PRODUCING SAME

BACKGROUND OF THE INVENTION

The present invention relates to electric heating units for use in furnaces and like heating devices and a method of producing the unit, and more particularly to a heating unit which comprises a heat-insulating main body consisting primarily of a heat-insulating material such as ceramic fiber and formed with a groove in a surface thereof, and a heating element shaped in the form of waves and supported by the main body integrally therewith as disposed in the groove, and to a method of producing the heating unit by vacuum molding.

The specification of U.S. Pat. No. 4,575,619 (JP-A-243992/1985) discloses an electric heating unit which comprises a heat-insulating main body consisting mainly of ceramic fibers and formed with a groove in a surface thereof, and a resistance heating element shaped in the form of waves in a plane and embedded in the bottom of the groove integrally with the main body. The wavelike heating element is self-supportable in the vicinity of the surface of the heat-insulating main body and radiates heat to the outside apparently more freely than a conventional helical heating element which is distributed over a specified width in the direction of thickness of a heat-insulating main body, so that the disclosed unit has the advantage that overheating of the heating element can be less than conventionally.

The heating unit described nevertheless has the problem to be described below. FIGS. 18 and 19 show part of the heating unit. Indicated at 1 is the heat-insulating main body made primarily of ceramic fibers and having a heating surface 1*a* and a nonheating cold surface 1*b* opposite to the heating surface 1*a,* at 2 the groove formed in the heating surface 1*a,* and at 2*a* the bottom of the groove 2. Indicated at 2*b* are opposite side walls defining the groove 2, at 3 is the heater shaped in the form of waves and having bent portions 3*a* at the widthwise opposite sides thereof. As illustrated in these drawings, only very small portions of the heating element 3 are exposed to a free space at the bottom 2*a* of the groove 2, and a major portion thereof is surrounded by the main body 1. Moreover, the bent portions 3*a* of the heater 3 extend through the side walls 2*b* and are completely embedded in the main body 1. With this construction, the surface of the heating element 3 is almost completely covered with the main body 1, and the ratio of the exposed surface capable of freely radiating thermal energy toward the space to the entire surface of the heating element 3 is very small. Accordingly, not only the heating element 3 is liable to overheat but an increased quantity of heat also escapes toward the nonheating cold surface 1*b* through the heat-insulating layer of the main body 1. The unit therefore has the problem of being low in heating efficiency and failing to serve a satisfactory life especially when used at a high temperature since the heating element 3 deteriorates and becomes consumed and consequently broken.

Accordingly, another heating unit has been proposed which is shown in FIG. 20 and wherein bent portions 3*a* of a heating element 3 extend into a heat-insulating main body 1 from opposite side walls thereof defining a groove 2 at a position away from the bottom 2*a* of the groove 2 toward the groove opening side and are embedded in and supported by the main body 1, the entire surface of the heating element 3 within the groove 2 being exposed outside the main body 1. For example, JP-U-89300/1990 discloses an example of such heating unit which differs from the above unit in that two heating elements are used instead of one. FIG. 21 shows an example of process for producing such a heating unit. Indicated at 4 is a vacuum mold, at 5 a screen comprising, for example, a perforated metal plate and horizontally disposed within the mold 4, and at 6 an evacuating hole formed in a wall portion of the mold 4 below the screen 5. In fabricating the heating unit, first mask members 7 in the form of a rectangular bar are first placed on the screen 5 each for forming the portion of the groove 2 toward the opening side thereof beyond the heating element 3, wavelike heating elements 3 are placed on the respective mask members 7, and second mask members 8 in the form of a rectangular bar are placed on the heaters 3 each for forming the other portion of the groove 2 toward the bottom side thereof beyond the heating element 3. A heat-insulating material layer 9 is then formed on the screen 5 around the heating elements 3 and the mask members 7, 8 by known vacuum molding, followed by heating for drying and rigidizing to form a heat-insulating main body 1. The mask members 7, 8 are thereafter removed from the main body 1 to form grooves 2. The first mask member 7 can be removed toward the opening side of the groove 2 and is therefore easily removable, whereas since the heating element 3 is present inwardly of the opening side of the groove 2, the second mask member 8 needs to be moved through the space between the bottom of the groove 2 and the heating element 3 longitudinally of the groove 2 and withdrawn from one end of the groove 2. Accordingly, the second mask members 8 are removed one by one manually, and the fabrication of the unit has the problem that this procedure is very cumbersome.

SUMMARY OF THE INVENTION

An object of the present invention is to provide a heating unit wherein the greatest possible area of surface of a heating element can be exposed outside a heat-insulating main body and which is easy to produce.

Another object of the invention is to provide a method of producing a heating unit with ease and at a low cost, the heating unit having a heating element which is exposed outside a heat-insulating main body over the greatest possible area of surface of the heating element.

The invention provides an electric heating unit which comprises a heat-insulating main body consisting primarily of a heat insulating material and formed with a groove in a surface thereof, and a heating element provided in the groove and shaped in the form of waves with an amplitude greater than the width of the groove, the heating element having at widthwise opposite sides thereof bent portions extending into the main body from groove-defining opposite side walls thereof and thereby supported by the main body integrally therewith, the electric heating unit being characterized in that a bottom-forming member of refractory material made separately from the heat-insulating main body covers a bottom of the groove and is supported by the main body integrally therewith so that a surface of the bottom-forming member toward an opening of the groove is exposed from the main body, the heating element being disposed closer to the groove opening than the bottom-forming member and supported by the main body integrally therewith so as to be in contact with portions of the surface of the bottom-forming member, the heating element being positioned within the groove and exposed outside the main body.

The invention also provides an electric heating unit produced by vacuum molding and comprising a heat-insulating molded body consisting mainly of ceramic fibers and formed with a groove in a surface thereof, and a heating element shaped in the form of waves and supported as provided in the groove by the molded body integrally therewith, the electric heating unit being characterized in that the molded body is caused to support a bottom-forming member of refractory material and the heating element thereon integrally therewith by disposing the bottom-forming member on the heating element in contact with portions of the element and out of contact with a groove-forming ridge portion provided or placed in position within a vacuum mold, the heating element being shaped in the form of waves and disposed along the ridge portion so as to be at least partly in contact with the ridge portion, the bottom-forming member being externally so dimensioned in section orthogonal to the ridge portion as to cover a portion of the heating element included in the amplitude of waveform of the element and approximately corresponding to the width of the ridge portion, and subjecting the resulting arrangement to a vacuum molding operation.

The invention provides a method of producing by vacuum molding an electric heating unit comprising a heat-insulating molded body consisting mainly of cramic fibers and formed with a groove in a surface thereof, and a heating element shaped in the form of waves and supported as provided in the groove by the molded body integrally therewith, the method being characterized by disposing the heating element shaped in the form of waves along a groove-forming ridge portion provided or placed in position within a vacuum mold so as to be at least partly in contact with the ridge portion, disposing a bottom-forming member of refractory material on the heating element in contact with portions of the element and out of contact with the ridge portion, the bottom-forming member being externally so dimensioned in section orthogonal to the ridge portion as to cover a portion of the heating element included in the amplitude of waveform of the element and approximately corresponding to the width of the ridge portion, and subjecting the resulting arrangement to a vacuum molding operation to prepare a heat-insulting molded body integrally with the bottom-forming member and the heating element.

To describe the production method of the invention, the heating unit is prepared, for example, in the following manner.

A mask member is placed on a screen inside a vacuum mold to provide a groove forming ridge portion. Next, a heating element in the form of waves is placed on the mask member, and a bottom-forming member on the heating element. In this state, a slurry containing ceramic fibers is introduced into the space inside the mold above its screen, followed by vacuum molding, whereby the ceramic fibers in the slurry are accumulated on the upper surface of the screen within the mold and on the surfaces of the mask member, the heating element and the bottom-forming member, forming a heat-insulating molded body providing a heat-insulating main body. Ceramic fibers do not accumulate in the portion where the mask member is present. The bottom-forming member acts also as a mask, preventing accumulation of ceramic fibers around the portions of the heating element disposed in the vicinity of the bottom-forming member. On completion of the vacuum molding operation, the molded body is removed from the mold and heated for drying and rigidizing, and the mask member is removed. Consequently, the bottom-forming member is supported by the bottom of a groove in the heating surface of the heat-insulating main body integrally with the main body, and the heating element is integrally supported by the main body so as to be positioned within the groove and exposed outside the main body to provide a heating unit of the invention.

In the method of the invention described, the bottom-forming member serves as a mask, preventing the heat-insulating material from accumulating around the surface of the heating element, so that the heating element of the heating unit obtained is supported as exposed inside the groove in the surface of the heat-insulting body. The groove-forming ridge portion, i.e., the mask member, is easily removable from the opening side of the groove, while the bottom-forming member, which is made of refractory material, need not be removed from the molded product but can be left as it is as a portion of the heat-insulting main body of the heating unit for use. Thus, the invention eliminates the need for the conventional cumbersome manual procedure for removing the mask member. The heating unit wherein the heating element is so supported as to be exposed within the groove in the surface of the heat-insulting main body can be produced easily and inexpensively by the method of the invention.

With the heating unit of the invention, a major portion of the surface of the heating element can be exposed outside the heat-insulating main body as spaced apart from the main body by the bottom-forming member. This enables the heating element to freely radiate heat toward a space, diminishes overheating of the heating element and achieves a very high heating efficiency.

In producing the heating unit with use of a screen, the screen has a suitably determined shape, such as planar, cylindrical, divided cylindrical or other curved shape, in conformity with the shape required of the heating unit.

To be suitable, the groove forming ridge portion is provided by placing a mask member in the form of an aluminum or like metal bar on the screen. However, the ridge portion may be provided by placing on the screen a mask member in the form of a tube of rectangular cross section prepared from a perforated metal plate like the screen. The ridge portion may be formed integrally with the screen on it supper side.

The groove-forming ridge portion has a width equal to the width of the groove of the heat-insulating main body and smaller than the amplitude of waveform of the heating element. The bottom-forming member has an outside width which is preferably approximately equal to the width of the groove, more preferably slightly greater than the width of the groove. If the width is too small, a satisfactory masking effect is unexpectable, whereas an excessively great width is likely to result in insufficient accumulation of the heat-insulating material.

Although a desired heat-insulating material is usable for forming the heat-insulating main body, a ceramic fiber is especially desirable. The material for the bottom-forming member can be selected suitably and is not limited specifically, but a lightweight refractory material is suitable. In the case where the heat-insulating material is a ceramic fiber material, a molded product consisting mainly of ceramic fiber material is especially suitable in ensuring conformity between the materials of the entire heating unit.

The molding density of the bottom-forming member is adjustable by conventional techniques over a wide range in accordance with the shape and the desired strength and heat-insulating properties thereof. For example, a low-density molded product having numerous voids or pores therein is usable as the bottom-forming member.

The surface of the bottom-forming member exposed from the heat-insulating main body and facing the heating element may be provided by a highly emissive material or highly reflecting material. A paste or liquid containing a powder of silicon carbide or the like is commercially available as a highly emissive material. A bottom-forming member coated with the material over the desired surface can be readily prepared by coating or impregnating the surface with the paste or liquid and drying the surface. If a highly emissive fiber material becomes available in the future, the fiber material can be directly molded into a bottom-forming member by a known technique for use.

The bottom-forming member can be modified variously in shape. An optimum shape can be selected in accordance with the mode or purpose of using the heating unit.

For example, the surface of the bottom-forming member toward the groove opening is made uneven, and the uneven surface has a protrudent portion partly in contact with the heating element. The heating element can then be reliably supported by the protrudent portion of the uneven surface. The heating element is out of contact with an indented portion of the uneven surface of the bottom-forming member and can therefore be exposed over an increased area.

For example, the surface of the bottom-forming member toward the groove opening is formed, except at widthwise opposite sides thereof, with a furrow extending longitudinally of the groove and is thereby made uneven. The heating element can then be reliably supported by protrudent portions at opposite sides of the furrow, is out of contact with the bottom-forming member at the portion of the furrow which has a large width, and is therefore exposed over an increased area. The heating element is usually planar, whereas when such a bottom-forming member is used, the exposed portions of the heating element within the groove may be made protrudent to project into the furrow of the member.

For example, the surface of the bottom-forming member toward the groove opening is formed on its widthwise central portion with a ridge extending longitudinally of the groove and is thereby made uneven.

For example, the surface of the bottom-forming member toward the groove opening is formed with a plurality of projections and thereby made uneven. The projections are shaped as desired when seen from above and in section.

The surface of the bottom-forming member toward the groove opening can be formed with a plurality of cavities and thereby made uneven. For example, the bottom-forming member can be honeycombed and thereby formed with cavities in one surface thereof.

For example, the bottom-forming member is provided at widthwise opposite sides thereof with heating element support portions supported respectively by the groove-defining opposite side walls integrally therewith and having recessed faces opposed to each other widthwise of the groove, and the bent portions of the heating element are in contact with, and supported by, the recessed faces.

For example, the furrow is formed at the widthwise central portion of its bottom with projections for gripping the heating element at the widthwise central portion thereof. The exposed portions of the heating element within the groove can then be held reliably.

A plurality of heating elements may be arranged within the single groove in the heat-insulating main body and supported by the main body. For example, at least one heating element is spaced apart from the heating element, which is in contact with the bottom-forming member, toward the groove opening by refractory spacers supported by the respective groove-defining opposite side walls integrally therewith, and these heating elements are spaced apart depthwise of the groove. Like the bottom-forming member, the spacers between the heating elements also serve as masks for vacuum molding, need not be removed from the resulting molded body and can be left as they are as portions of the heat-insulating main body of the heating unit for use.

DESCRIPTION OF THE PREFERRED EMBODIMENTS

Figure 1:
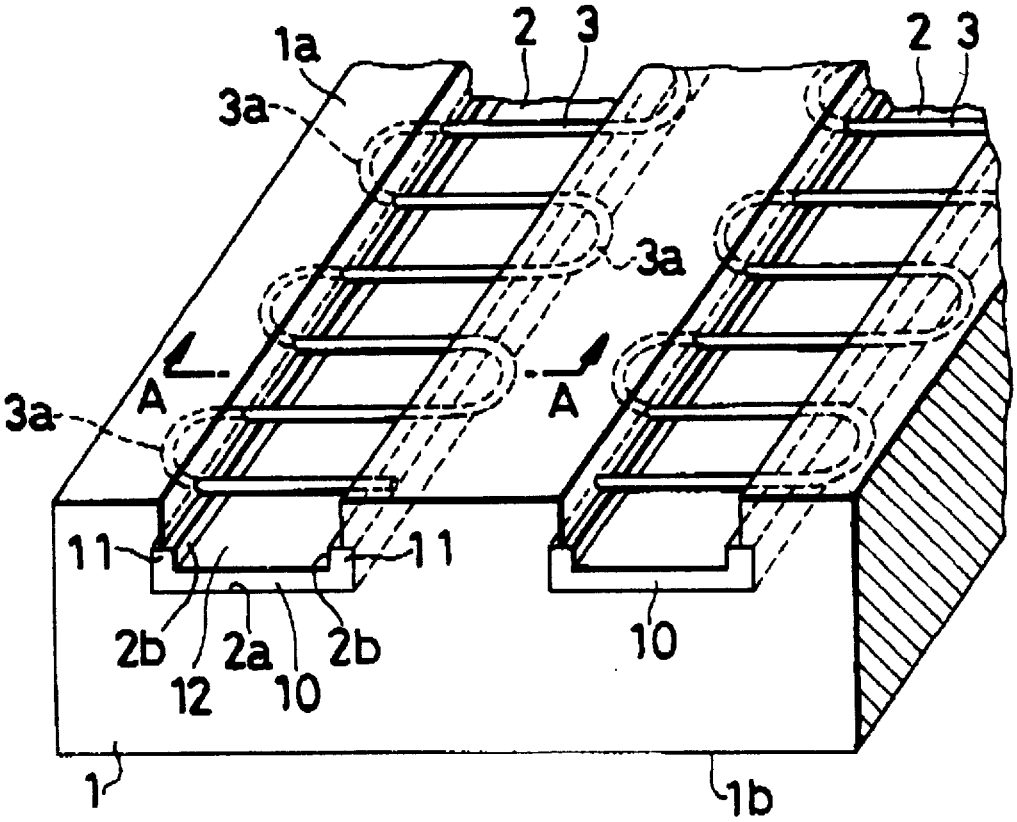
FIG. 1 is a perspective view of the main portion of a heating unit to show a first embodiment of the invention.

Several embodiments of the invention will be described below with reference to the drawings concerned. Throughout the accompanying drawings, like parts are designated by like reference numerals or symbols.

First Embodiment

Figure 2:
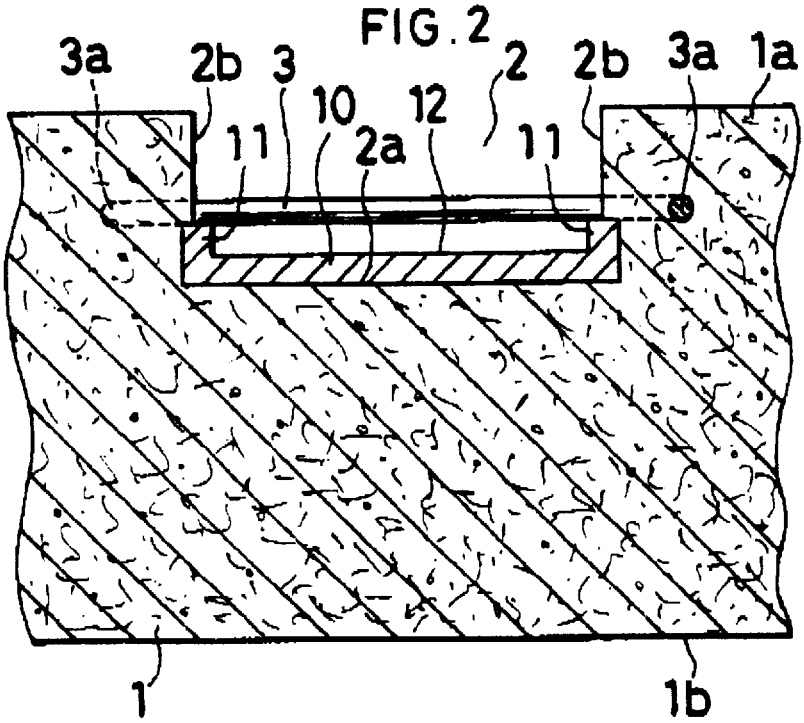
FIG. 2 is an enlarged view in section taken along the line A—A in FIG. 1.

FIGS. 1 and 2 show the main portion of heating unit of a first embodiment.

With reference to FIGS. 1 and 2, a heat insulating main body 1 consisting primarily of ceramic fibers as a heat-insulating material is formed in a heating surface 1*a* thereof with grooves 2 which are approximately rectangular in cross section. A bottom-forming member 10 in the form of a plate and made from a refractory material separately from the main body 1 covers and is supported by the bottom 2*a* of each groove 2 integrally with the body 1 so that the surface of the member 10 toward the open side of the groove 2 is exposed from the main body 1. A heating element 3 in the form of waves is provided in the groove 2 and positioned closer to the groove opening than the bottom-forming member 10. The heating element 3 has at opposite sides thereof bent portions 3*a* extending into the main body 1 from opposite side walls 2*b* defining the groove 2, and is thereby integrally supported by the main body 1.

The bottom-forming member 10 is preferably a molded product consisting mainly of ceramic fibers like the main body 1. The surface of the member 10 toward the open side of the groove 2 is formed at each of its widthwise opposite sides with a ridge 11 having a rectangular cross section and extending longitudinally of the groove 2. The ridges 11 define therebetween a furrow 12 having a large width and a rectangular cross section and extending longitudinally of the groove 2. Consequently, the surface of the member 10 toward the groove opening is made uneven. The bottom-forming member 10 has an outside width slightly greater than the width of the groove 2. The width of the furrow 12 is slightly smaller than the width of the groove 2. Each groove-defining side wall 2*b* is positioned at the widthwise midportion of top face of the ridge 11 at each side of the member 10, and the widthwise outer portion of the ridge 11 is embedded in the portion of the side wall 2*b* toward the bottom 2*a*, whereby the member 10 is reliably supported by the main body 1. The portion of top face of each ridge 11 closer to the furrow 12 and the furrowed surface of the member 10 are exposed inside the groove 2.

The heating element 3 is so disposed that the opposite side portions thereof extending into the groove-defining side walls 2*b* are in contact with the top faces of the respective ridges 11 at opposite sides of the member 10. The element 3 is completely away from both the main body I and the bottom-forming member 10 at the portions thereof having a large width and corresponding to the furrow 12 of the member 10. The entire surfaces of these heating element portions are exposed inside the groove 2. This enables the heating element 3 to freely radiate heat toward a space, renders the element 3 less likely to overheat and reduces the quantity of heat escaping toward the nonheating cold surface 1*b*.

Figure 3:
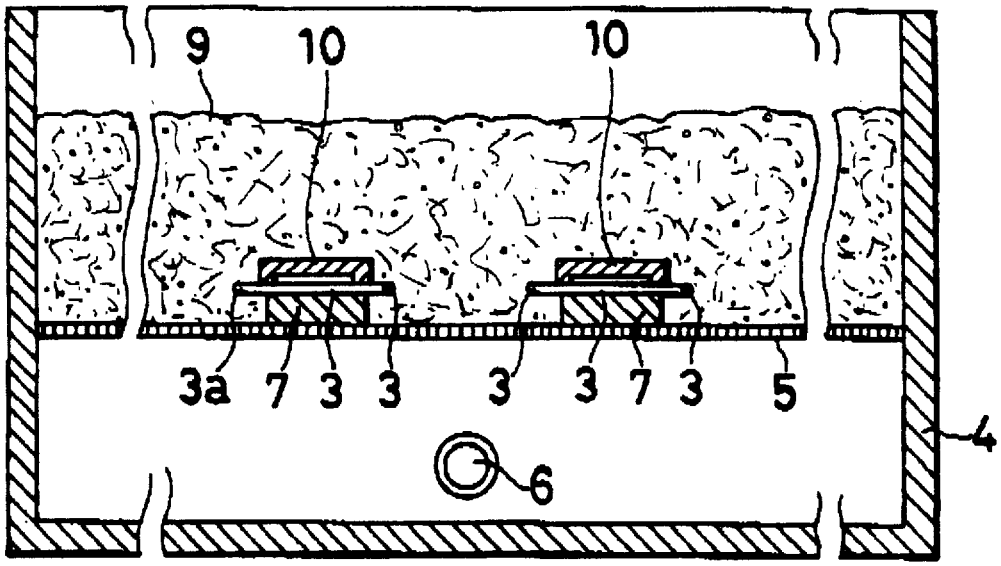
FIG. 3 is a view in vertical section of a production device with an intermediate portion omitted to show an example of method of producing the heating unit of the first embodiment.

FIG. 3 shows an example of method of producing the heating unit.

Figure 21:
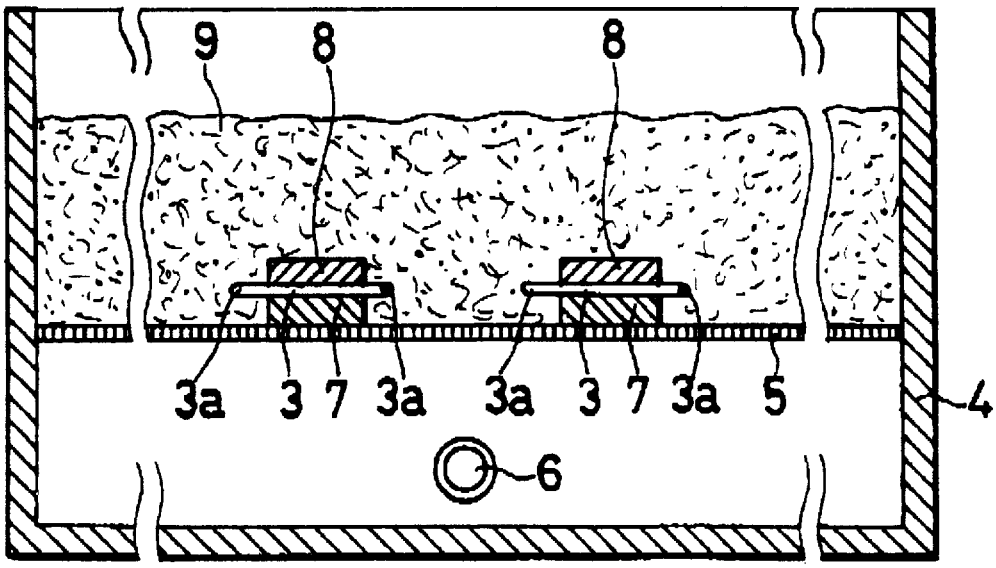
FIG. 21 is a view in vertical section of a production device with an intermediate portion omitted to show a method of producing the heating unit of FIG. 20.

The production device shown in FIG. 3 is similar to that of FIG. 21 already described. A mold 4 is made in the form of a box from a suitable material such as acrylic plate. A screen 5 is disposed horizontally within the mold 4 at an intermediate portion of its height. An evacuating hole 6 is in communication with unillustrated known evacuating means.

The heating unit is produced, for example, in the following manner.

First, mask members 7 in the form of a rectangular aluminum bar are placed on the screen 5 to provide groove-forming ridge portions on the screen 5. Next, a heating element 3 is placed on each mask member 7, and a bottom forming member 10 on the element 3. At this time, the bent portions 3*a* of the heating element 3 at its opposite sides are positioned as projected outward widthwise beyond the mask member 7 and the bottom-forming member 10. In this state, the mold 4 is immersed in a slurry comprising water, binder and ceramic fibers, and at the same time, the evacuating means is activated, causing vacuum suction to act on the space under the screen 5 to introduce the slurry into the space above the screen 5. The vacuum suction acts on the slurry through the screen 5, causing ceramic fibers dispersed in the slurry to accumulate on the upper surface of the screen 5 and surfaces of each mask member 7, heating element 3 and bottom-forming member 10 within the mold 4 when the slurry flows onto the upper side of the screen 5 and to form a heat-insulating layer 9 providing a heat-insulating main body 1. Ceramic fibers do not accumulate in the portion where the mask member 7 is present. While ceramic fibers accumulate around the bent portions 3*a* of the heating element 3 outwardly projecting widthwise beyond the mask member 7 and the bottom-forming member 10 to embed the bent portions 3*a* in the main body 1, the member 10 also serves as a mask for blocking the suction, and the furrowed portion 12 of the member 10 and the portions of the heating element 3 between the member 10 and the mask member 7 are covered with the member 10 against the flow of the slurry, so that no ceramic fibers accumulate inside the furrow 12 and around the heating element 3. On completion of the vacuum molding operation, the molded product is removed from the mold 4 and heated for drying and curing, and the mask member 7 is removed. As a result, a heating unit is obtained which is shown in FIGS. 1 and 2 and in which the bottom-forming member 10 is integrally supported by the bottom 2*a* of each groove 2 in the heating surface 1*a* of the main body 1, and the heating element 3 is positioned inside the groove 2 and exposed outside the main body 1. With this heating unit, the surface facing the screen 5 of the mold 4 provides the heating surface 1*a*, and the portion where the mask member 7 was present provides the portion of the groove 2 in the surface 1*a* positioned closer to the open side than the heating element 3.

The vacuum molding operation described is known. A temporary molding operation is performed with the mask member 6, heating element 3 and bottom-forming member 10 supported in position within the mold 4 by respective suitable jigs so as to hold these members by the operation, followed by removal of the jigs and primary molding operation.

The ridges 11 and the furrow 12 of the bottom-forming member 10 are not limited to a rectangular shape in cross section but can be given a suitably altered form.

Second Embodiment

Figure 4:
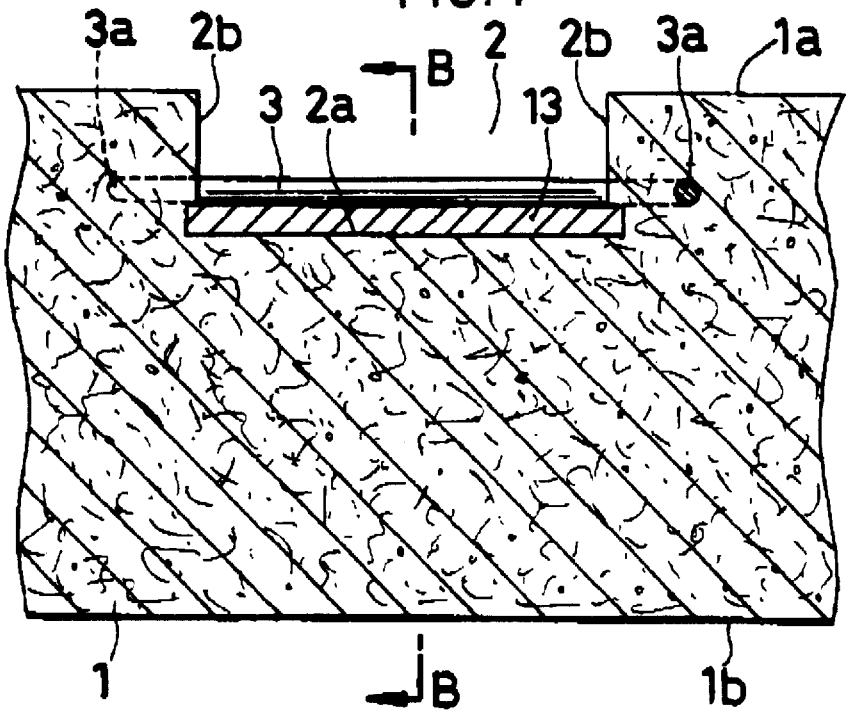
FIG. 4 is a sectional view of the main portion of a heating unit to show a second embodiment of the invention.
Figure 5:
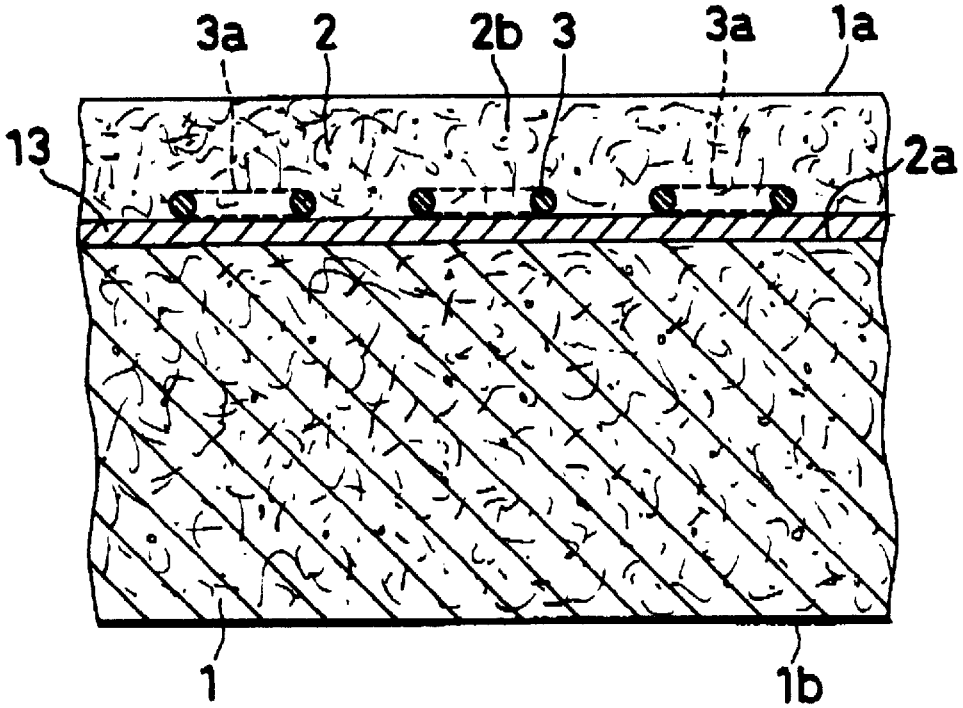
FIG. 5 is a view in section taken along the line B—B in FIG. 4.

FIGS. 4 and 5 show the main portion of heating unit of a second embodiment.

The second embodiment has a bottom-forming member 13 in the form of a plate having a rectangular cross section. The width of the member 13 is slightly greater than that of a groove 2. Each side portion of the member 13 is embedded in the portion of a side wall 2*b* toward a bottom 2*a*, whereby the member 13 is reliably supported by a heat-insulating main body 1. The surface of the bottom-forming member 13 toward the opening of the groove 2 except for its opposite side portions is exposed inside the groove 2. The straight portions of a heating element 3 positioned within the groove 2 are in line contact with the surface of the member 13 but are each left exposed within the groove 2 over a major area.

The heating unit of the second embodiment is produced by vacuum molding in the same manner as the first embodiment. The bottom-forming member 13 functions as a mask also in this case, and the heating element 3 of the heating unit obtained is exposed inside the groove 2. Although the material for the bottom-forming member 13 may usually be the same as in the first embodiment, a low-density molded piece having numerous pores is usable when desired. Especially when a molded piece having numerous voids in its interior is used in this case, the heating element 3 in contact with the bottom-forming member 13 achieves the same effect to freely radiate heat as in an air layer.

Third Embodiment

The finish of the surface of the bottom-forming member opposed to the heating element 3 is not limited particularly; the surface may be flat as in the second embodiment or made uneven with projections and indentations. Although the labor required for preparing an uneven surface with projections and indentations is almost the same as that needed for preparing a flat surface, the surface projections and indentations reduce the area of contact between the heating element 3 and the bottom-forming member, giving an increased area of free surface to the element 3 to achieve a greatly improved heat radiating efficiency.

Figure 6:
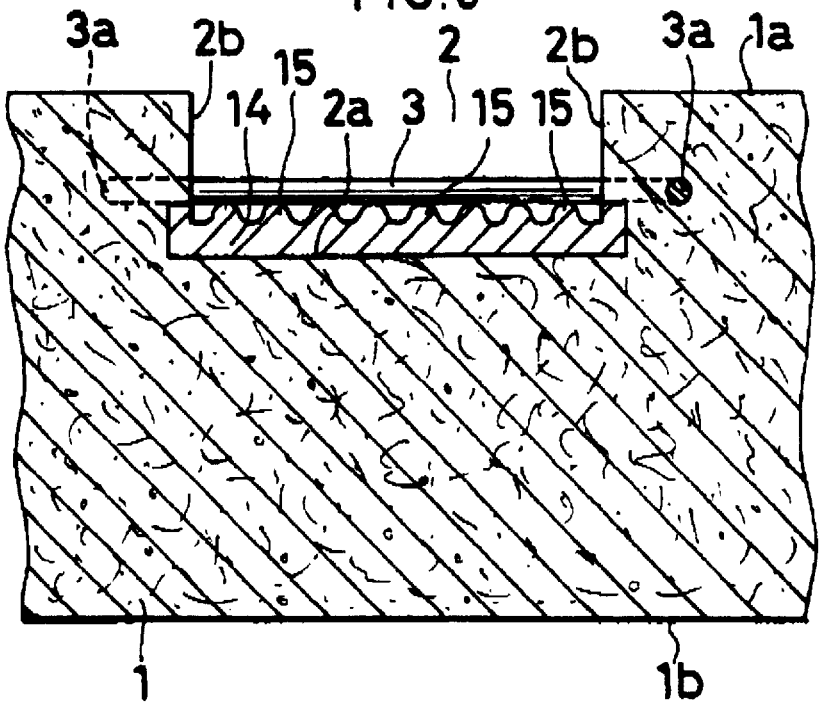
FIG. 6 is a sectional view of the main portion of a heating unit to show a third embodiment of the invention.
Figure 7:
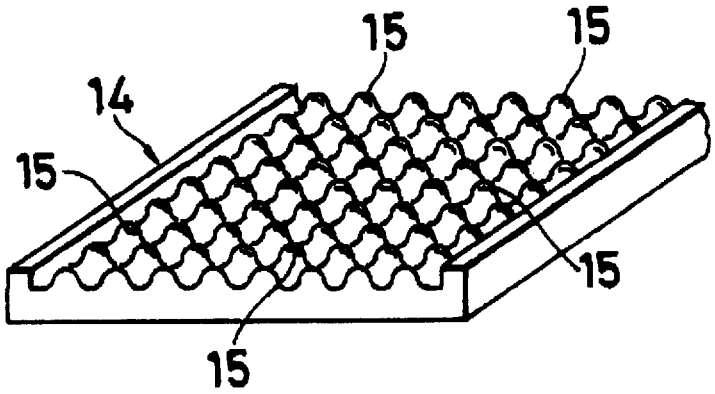
FIG. 7 is a perspective view showing an example of bottom-forming member of the heating unit of the third embodiment.

FIG. 6 shows an embodiment (third embodiment) wherein a bottom-forming member 14 has a surface formed with projections and indentations, and FIG. 7 shows the member 14.

In the case of the third embodiment, the surface of the bottom-forming member 14 has projections and indentations in the form of waves in section, and a heating element 3 exposed inside the groove 2 are in contact with some of the projections 15.

Figure 8:
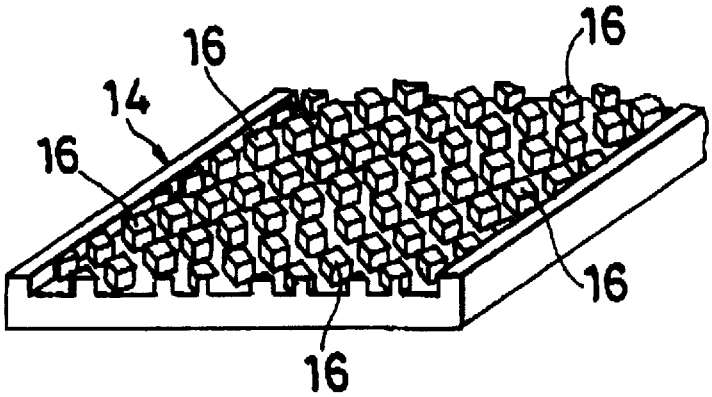
FIG. 8 is a perspective view showing a modified bottom-forming member of the heating unit of the third embodiment.

FIG. 8 shows a modification of the bottom-forming member 14 of the third embodiment.

In this case, a multiplicity of furrows obliquely extending across one another are formed in the surface of the member 14, whereby many projections 16 in the form of prisms are formed to render the surface uneven. The heating element 3 is in contact with some of the projections 16.

Fourth Embodiment

Figure 9:
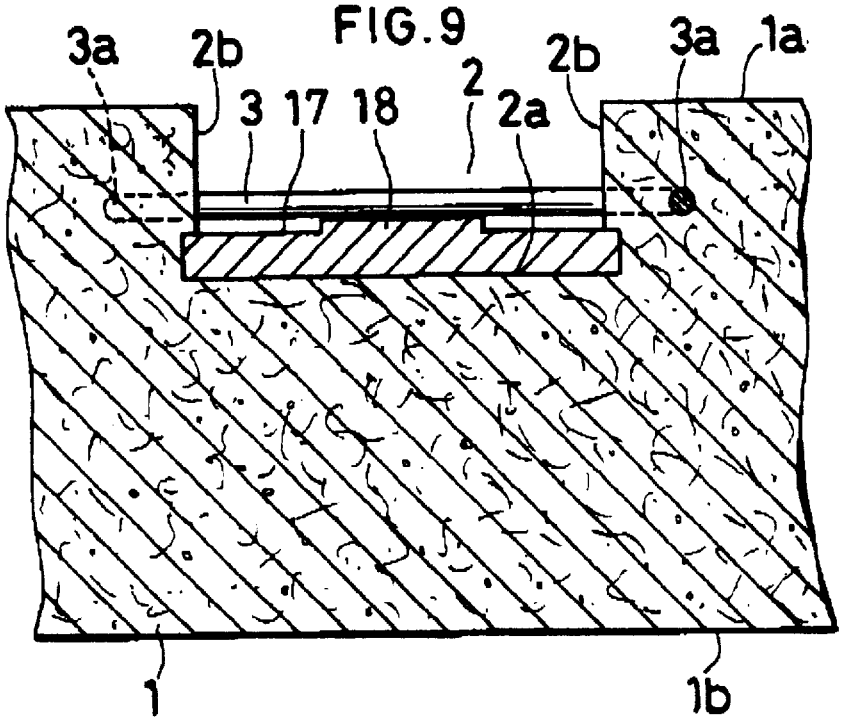
FIG. 9 is a sectional view of the main portion of a heating unit to show a fourth embodiment of the invention.

FIG. 9 shows another embodiment (fourth embodiment) having a bottom-forming member 17 with an uneven surface.

With the fourth embodiment, the bottom-forming member 17, which is in the form of a plate, has a surface exposed inside a groove 2 and formed with a ridge 18 of rectangular cross section on the widthwise central portion of the surface. A heating element 3 exposed inside the groove 2 is in contact with the top face of the ridge 18. The ridge 18 needs to be so shaped as to exhibit good self-supporting stability during vacuum molding and therefore must have a considerable width.

The cross-sectional shape of the ridge 18 need not always be rectangular but is variable suitably. The member 17 need not always have one ridge 18 but may have at least two ridges depending on the width of the heating element 3. The ridges 18 will then have a sufficient combined width. In any case, the bottom-forming member 17 can be readily prepared by a conventional technique.

Fifth Embodiment

Figure 10:
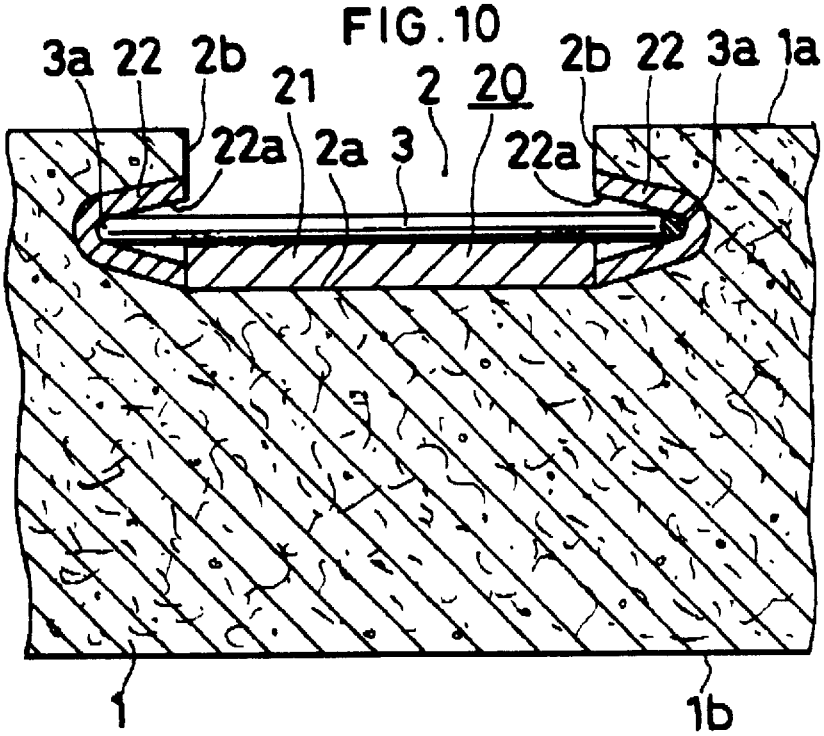
FIG. 10 is a sectional view of the main portion of a heating unit to show a fifth embodiment of the invention.

FIG. 10 shows the main portion of heating unit of a fifth embodiment.

The fifth embodiment has a bottom-forming member 20 which comprises a platelike bottom-forming portion 21 similar to the bottom-forming member 13 of the second embodiment, and heating element support portions 22 arranged at respective opposite sides of the portion 21. The heating element support portions 22 are made separately from the bottom-forming portion 21 and generally V-shaped in cross section and have a recessed inner faces 22*a*. The support portions 22 are embedded in the portions of opposite side walls 2*b* close to a bottom 2*a*, with their recessed faces 22*a* opposed to each other widthwise of the groove 2, and are integrally supported by a heat-insulating main body 1. A bent portion 3*a* at each side of a heating element 3 tightly fits in the bottom of recessed face 22*a* of the support portion 22, whereby the heating element 3 is supported by the main body 1 integrally therewith. The width of the bottom-forming portion 21 is approximately equal to the width of the groove 2. The bottom-forming portion 21 is held between the opposed support portions 22 and disposed on the bottom 2*a* so that the surface of the portions 21 toward the opening side of the groove 2 is in contact with the heating element 3. Thus, the bottom-forming portion 21 is supported on the main body 1 integrally therewith by means of the support portions 22 and the heating element 3.

The heating unit of the fifth embodiment is produced by the method to be described below with reference to FIG. 3 previously described. A heating element 3 is placed on each mask member 7, a bottom-forming portion 21 is thereafter placed on the heating element 3, and heating element support portions 22 are fitted to the respective bent portions 3*a* of the heating element 3 projecting beyond the mask member 7 and the portion 21. A vacuum molding operation is then performed in the same manner as is the case with the first embodiment. During the operation, the bottom-forming portion 21 serves as a mask, preventing accumulation of ceramic fibers on the heating element 3, and the heating element support portions 22 also function as masks, preventing accumulation of ceramic fibers on the recessed faces 22*a* and the bent portions 3*a* of the element 3. The operation affords a heating unit wherein the bent portions 3*a* are left exposed inside the support portions 22 and opposed to a groove 2, and the surface of the heating element 3 is substantially entirely exposed outside a heat-insulating main body 1. With the bent portions 3*a* of the heating element 3 also exposed outside the main body 1, the unit has the advantage of permitting the bent portions 3*a* to radiate heat efficiently.

With the embodiment described, the bottom-forming portion 21 and each support portion 22 are separately prepared and are not joined to each other, whereas these portions, as arranged in combination with the heating element 3, may be joined to each other by suitable means. Alternatively, a bottom-forming member 20 comprising a bottom forming portion 21 and heating element support portions 22 integral therewith can be used. In this case, the assembly of the heating element 3 and the bottom-forming member 20 prepared before vacuum molding is placed on the mask member 7.

The bottom-forming portion 21 and the heating element support portion 22 are not limited to those of the fifth embodiment in shape but can be modified suitably. A heating unit having the same advantage as described above can be produced similarly using a bottom-forming portion 21 which is similar, for example, to the bottom-forming member 10, 14 or 17 of the first, third or fourth embodiment.

Sixth Embodiment

Figure 11:
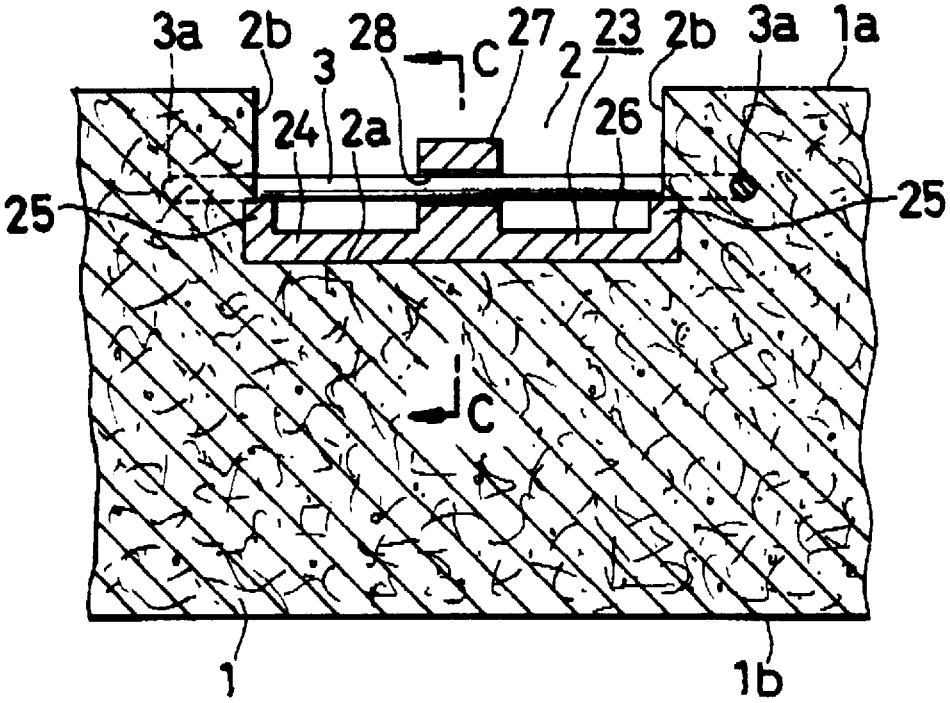
FIG. 11 is a sectional view of the main portion of a heating unit to show a sixth embodiment of the invention.
Figure 12:
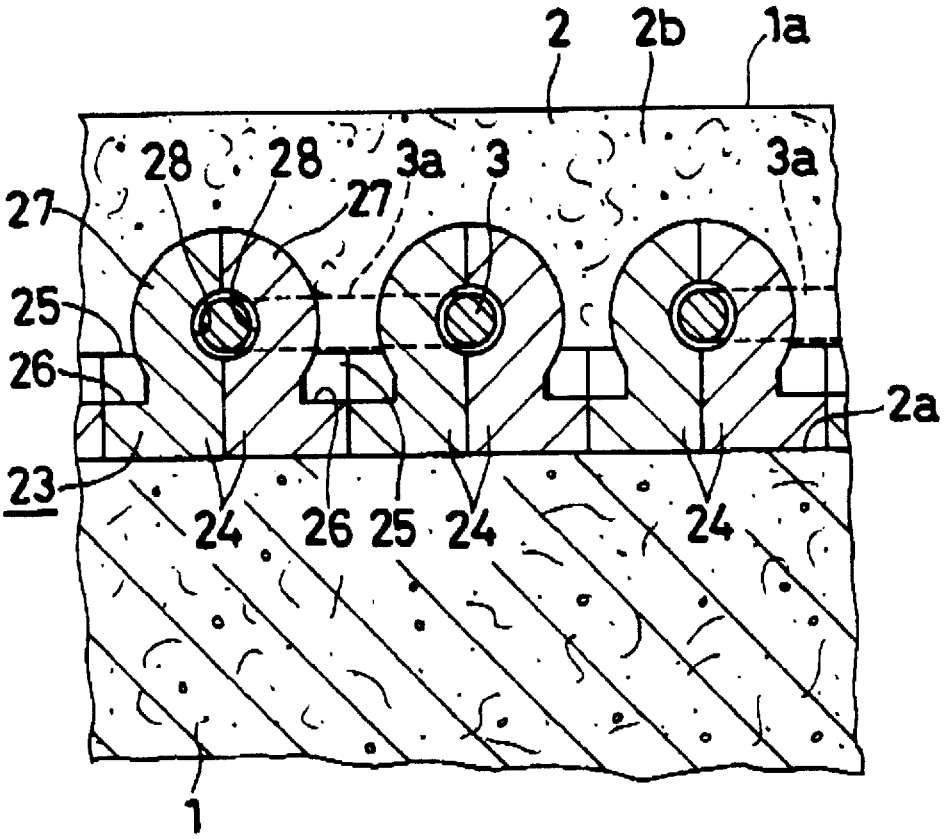
FIG. 12 is an enlarged view in section taken along the line C—C in FIG. 11.

FIGS. 11 and 12 show the main portion of heating unit of a sixth embodiment.

Figure 13:
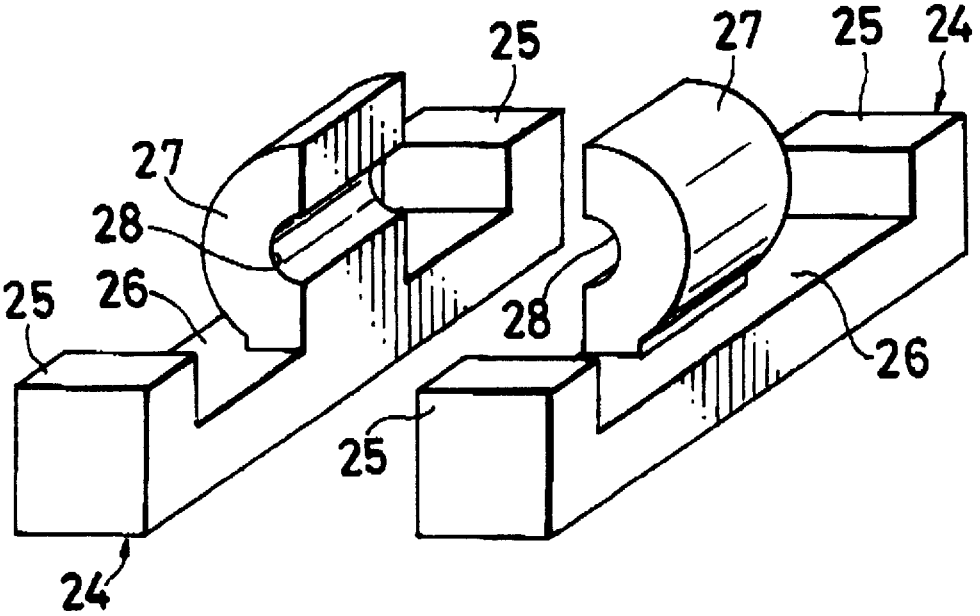
FIG. 13 is a perspective view showing an example of bottom-forming member of the heating unit of the sixth embodiment.

The sixth embodiment has a bottom-forming member 23 comprising a plurality of bottom-forming pieces 24 which are identical in shape. FIG. 13 shows the bottom-forming piece 24 in greater detail. The surface of the piece 24 to be positioned toward the opening side of a groove 2 is integrally formed with ridges 25 respectively at widthwise opposite sides thereof, the ridges 25 having a rectangular section and extending longitudinally of the groove 2. The ridges define therebetween a furrow 26 having a large width and extending longitudinally of the groove 2. The furrowed portion 26 is integrally formed, at one end of widthwise central part of the bottom thereof, with a projection 27 for gripping a widthwise central portion of a heating element 3. The projection has one face flush with one end face of the bottom-forming piece 24. The projection 27 is formed at an intermediate portion of height of the end face with a groove 28 extending in the widthwise direction and having a semicircular section. On the opposite side, the projection 27 has a semicylindrical face shaped in conformity with the shape of the groove 28 and positioned inwardly of the other end face of the piece 24 in the longitudinal direction. The projection 27 projects upward beyond the ridge 25, and the lower edge of the groove 28 is approximately at the same level as the top of the ridge 25.

A pair of bottom-forming pieces 24 are in combination, with their grooved faces in intimate contact with each other, and a plurality of such pairs are arranged longitudinally of the groove 2 in end-to-end intimate contact with one another without any clearance. The pieces 24 are integrally supported on a heat-insulating main body 1 like the bottom-forming member 10 of the first embodiment.

As is the case with the first embodiment, the heating element 3 is integrally supported at its opposite side bent portions 3*a* by the heat-insulating main body 1, in contact with the ridges 25 of the bottom-forming pieces 24 at opposite sides. The heating element 3 is gripped at its widthwise central portion by the projections 27 of each pair of pieces 24, as inserted through a bore of circular cross section formed by the combination of grooves 28 of the projections. The surface of the heating element 3 is exposed inside the groove 2 between opposite side walls 2*b* except for the heating element portions inserted through such bores of the projections 27.

The construction described is effective for preventing the deformation of the heater 3 due to creep elongation especially in the case where the unit is used at high temperatures.

The groove 28 of the projection 27 may be made triangular in cross section so as to insert the heating element 3 through a bore having a quadrangular cross section and provided by each pair of grooves 28 in combination. The heating element 3 within the bore is then in line contact with the projections 27 at four portions, with the remaining major portion of the heating element left exposed.

The heating unit of the sixth embodiment is produced by the method to be described below with reference to FIG. 3 previously described. A mask member 7 is used which is formed in its upper surface with cavities for fitting in the top ends of projections 27 of bottom-forming pieces 24. A heating element 3 and a plurality of pieces 24 are arranged into an assembly, which is then place on the mask member 7 with the top ends of the projections 27 fitted in the respective cavities, followed by a vacuum molding operation as in the case of the first embodiment.

It is usually suitable that the bottom-forming piece 24 to be used be shaped like the bottom-forming member 10 of the first embodiment, with the projection 27 formed thereon, so that the piece 24 exhibits good self-supporting stability during vacuum molding by virtue of its shape. However, the bottom-forming piece 24 of the embodiment need not always be used but can be modified suitably. Although the bottom-forming member 23 of the above embodiment comprises divided pieces 24, the bottom-forming member may alternatively be an integral piece in its entirety, with suitably shaped projections provided on suitable portions of the member for gripping widthwise central portions of the heating element 3.

Seventh Embodiment

Figure 14:
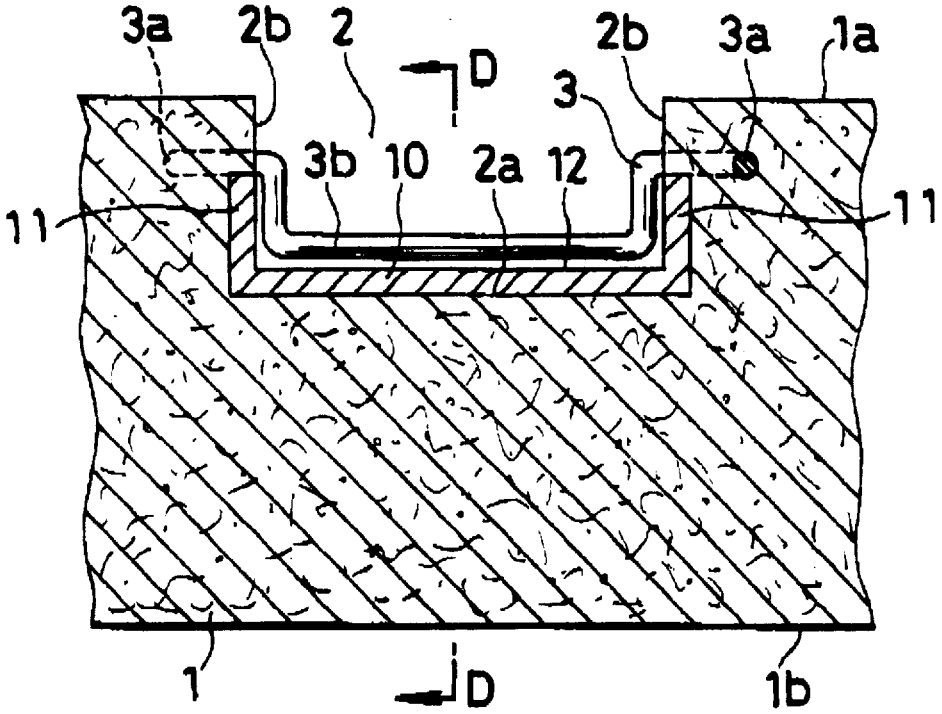
FIG. 14 is a sectional view of the main portion of a heating unit to show a seventh embodiment of the invention.
Figure 15:
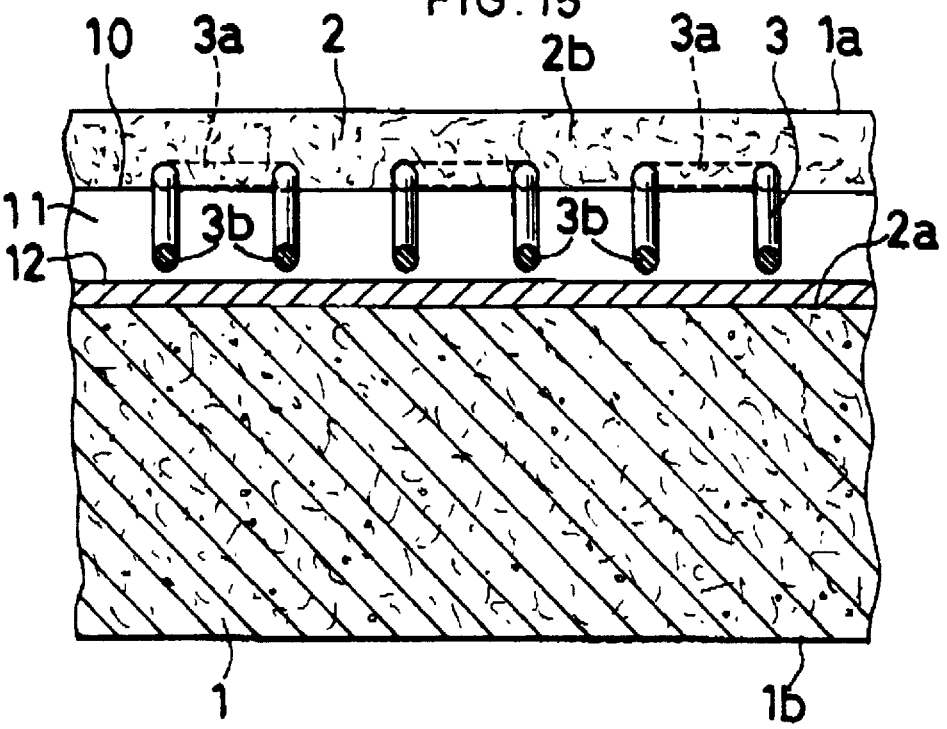
FIG. 15 is a view in section taken along the line D—D in FIG. 14.

FIGS. 14 and 15 show the main portion of heating unit of a seventh embodiment.

The seventh embodiment has a bottom-forming member 10 which is the same as that of the first embodiment except that the furrow 12 has a larger depth than in the first embodiment and an inside width approximately equal to the width of a groove 2. As in the case of the first embodiment, a heating element 3 is supported by a heat-insulating main body 1. The portions of the heating element 3 exposed within the groove 2 are each bent to a protrudent form as indicated at 3*b* so as to project into the furrow 12 of the bottom-forming member 10.

The heating unit is produced by the same method as the foregoing embodiments.

The present embodiment allows an increase in the density of the heating element 3 per unit area of the groove 2 and is therefore suited as a heating unit of high power density.

The protrudent form of the bent portions 3*a* of the heating element 3 need not be limited particularly. The form illustrated in FIG. 14 may alternatively be triangular or a curved form bulging outward or inward with a curvature although not shown.

Eighth Embodiment

Figure 16:
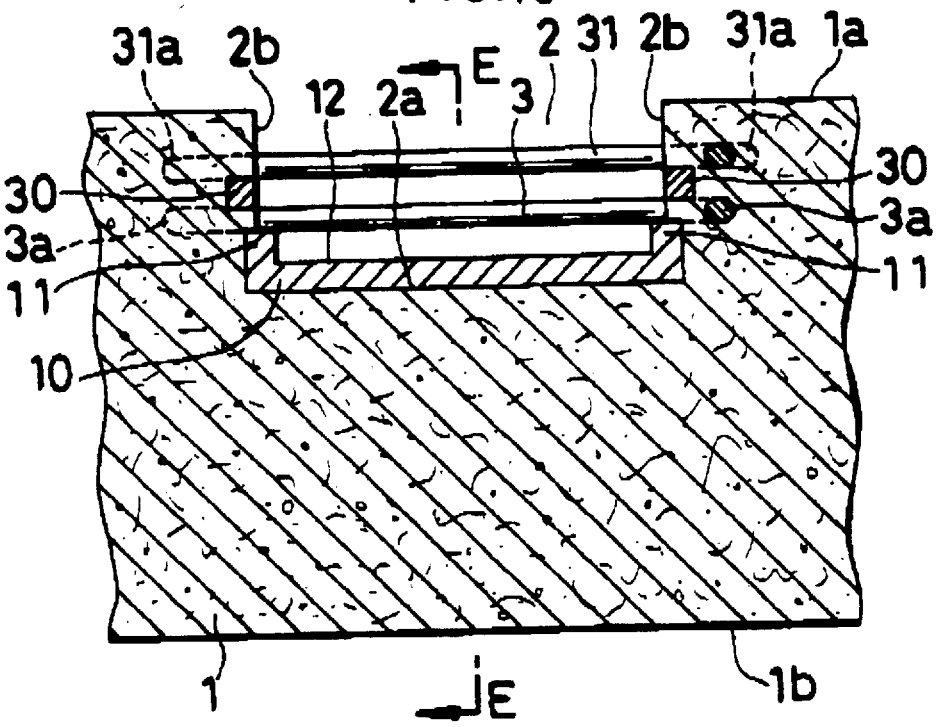
FIG. 16 is a sectional view of the main portion of a heating unit to show an eighth embodiment of the invention.
Figure 17:
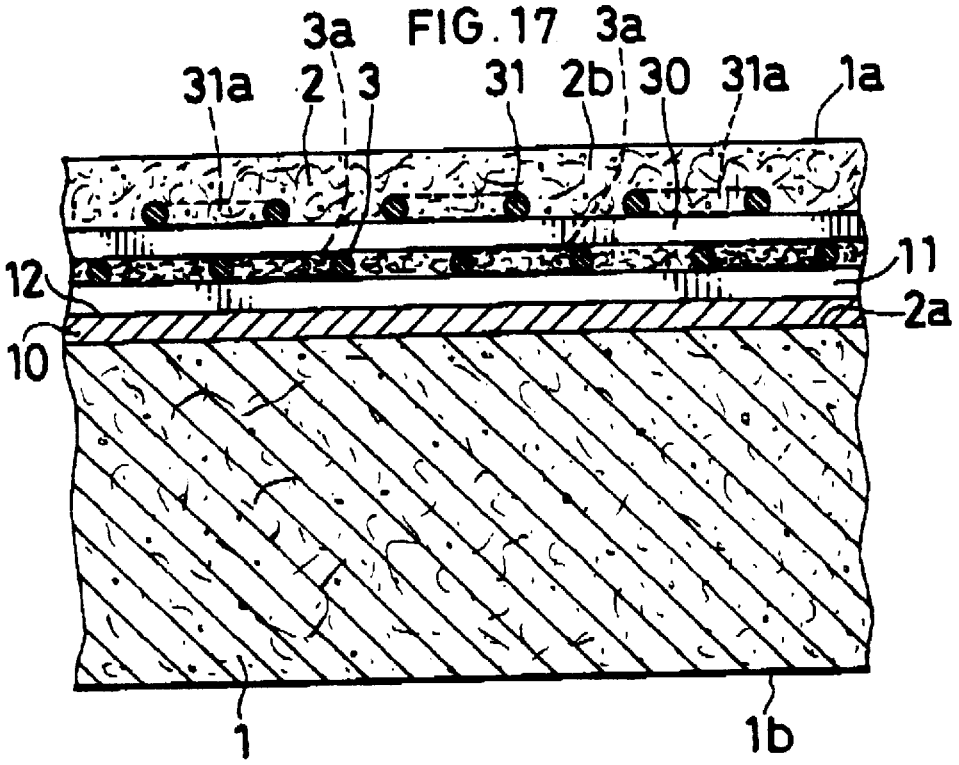
FIG. 17 is a view in section taken along the line E—E in FIG. 16.
Figure 18:
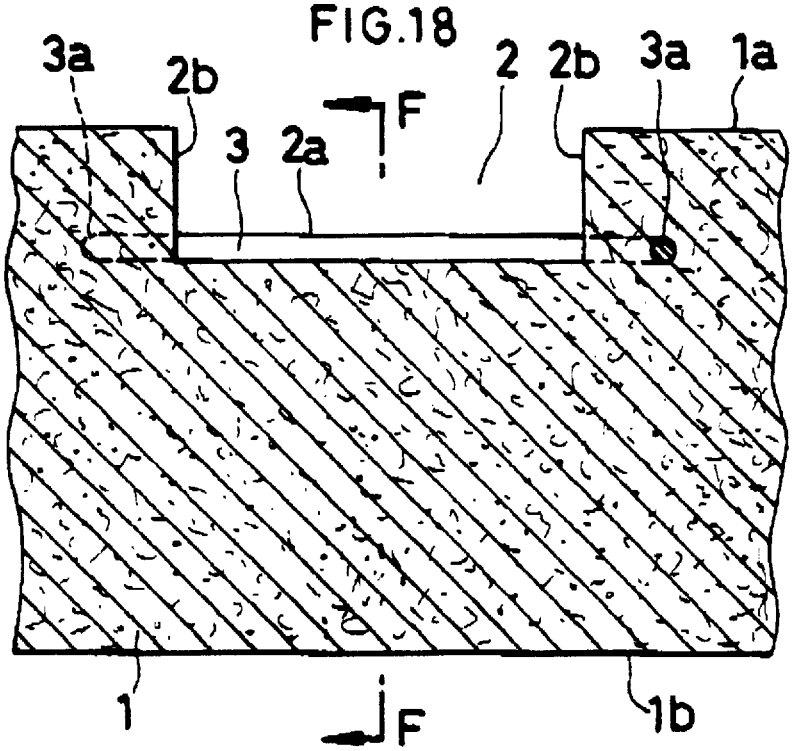
FIG. 18 is a sectional view of the main portion of a heating unit as a conventional example.
Figure 19:
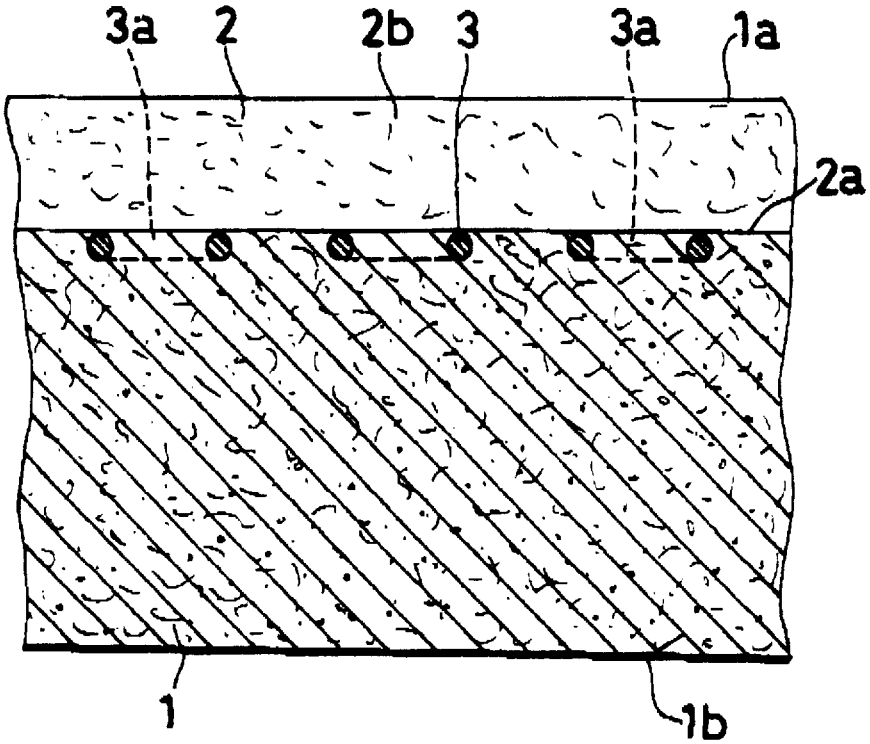
FIG. 19 is an enlarged view in section taken along the line F—F in FIG. 18.
Figure 20:
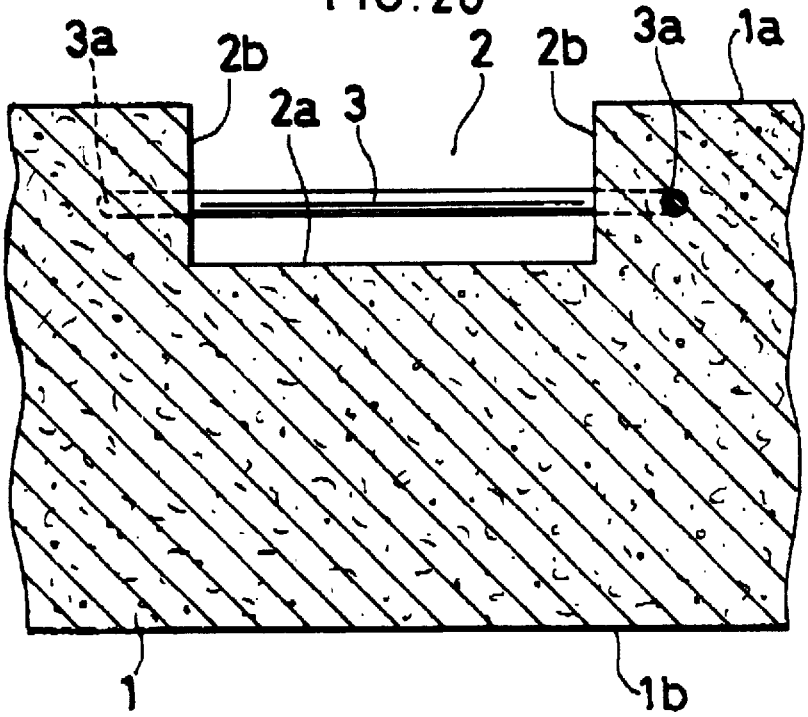
FIG. 20 is a sectional view of the main portion of a heating unit as another conventional example.

FIGS. 16 and 17 show the main portion of heating unit of an eighth embodiment.

According to the eighth embodiment, a bottom-forming member 10 and a first heating element 3 are integrally supported on the bottom 2*a* of a groove 2 in a heat-insulating main body 1 as in the case of the first embodiment. A pair of spacers 30 are arranged at one side of the first heating element 3 toward the opening of the groove 2, and a second heating element 31 is disposed at the groove opening side of the spacers 30. The second heating element 31 is identical with the first element 3 in shape, has opposite side bent portions 31*a* embedded in side walls 2*b* defining the groove 2 and is supported by the main body 1 integrally therewith. The spacers 30, each in the form of a rectangular bar extending longitudinally of the groove 2, are embedded in the groove-defining side walls 2*b*, as held between the portions of the two heating elements 3, 31 toward their opposite sides, and integrally supported by the main body 1. The opposed faces of the spacers 30 are each substantially flush with the surface of the groove-defining side wall 2*b*. The spaces 30 are made, for example, of ceramic fibers or like refractory material.

The heating unit of the eighth embodiment is produced by the method to be described below with reference to FIG. 3 previously described. A second heating element 31 is placed on a mask member 7, spacers 30 are placed on the respective portions of the second heating element 31 close to their opposite sides, a first heating element 3 is placed on the spacers, and a bottom-forming member 10 is further placed on the heating element 3, followed by a vacuum molding operation as is the case with the first embodiment. During the operation, the bottom-forming member 10 serves as a mask, preventing accumulation of ceramic fibers in the furrow 12 thereof and on the surface of the first heating element 3 as in the case of the first embodiment. The spacers 30 hold the two heating portions 3, 31 spaced apart and serve also as masks for preventing accumulation of ceramic fibers on the second heating element 31. Consequently, a heating unit is obtained wherein the two heating elements 3, 31 are exposed inside a groove 2.

The heating unit of the eighth embodiment is also suited as a unit of high power density. Although the position of the waveforms of the two heating elements 3, 31 relative to each other is not limited specifically, the waveforms are preferably out of phase so that heat can be radiated from the surfaces of the two heating elements 3, 31 as freely as possible. It is especially desirable that the absolute values of the phases are different by 180 deg, or by 90 deg as shown in FIG. 17.

The heating elements are not limited to two in number. Exactly the same holds true when at least three heating elements are provided. Of course, the heating element need not always be flat in shape as in the embodiment. For example, a heating element is usable which is bent at its widthwise central portion like that of the seventh embodiment.

The heating unit can be modified variously without departing from the scope of the present invention. In cross section, the groove of the heat-insulating main body is not limited to a rectangular or trapezoidal form but can be of a triangular, polygonal or curved form, and the main bodies of the foregoing embodiments given as examples can be so modified readily. In conformity with such modifications, the bottom-forming member, spacer or wavelike heating element can also be modified variously in section orthogonal to the width of the groove. Consequently, it is also easy to select a desired combination from among these modifications. Such combinations are merely minor alterations included within the technical scope of the invention. Furthermore, the present invention is applicable also to heating units which are produced by processes other than the vacuum molding process, for example, by casting a bottom-forming member of castable or like refractory material in a mold along with a heat-insulating main body and heating element to obtain an integral unit.

What is claimed is:

1. An electric heating unit comprising a heat-insulating main body consisting primarily of a heat-insulating material and formed with a groove in a surface thereof, and a heating element provided in the groove and shaped in the form of waves with an amplitude greater than the width of the groove, the heating element having at widthwise opposite sides thereof bent portions extending into the main body from groove-defining opposite side walls thereof and thereby supported by the main body integrally therewith, the electric heating unit being characterized in that a bottom-forming member of refractory material made separately from the heat-insulating main body covers a bottom of the groove and is supported by the main body integrally therewith so that a surface of the bottom-forming member toward an opening of the groove is exposed from the main body, the heating element being disposed closer to the groove opening than the bottom-forming member and supported by the main body integrally therewith so as to be in contact with portions of the surface of the bottom-forming member, the heating element being positioned within the groove and exposed outside the main body.

2. An electric heating unit as defined in claim 1 wherein the heat-insulating material forming the main body and the bottom-forming member are each a molded product consisting mainly of ceramic fibers.

3. An electric heating unit as defined in claim 1 wherein the bottom-forming member comprises a low-density molded product having numerous voids or pores therein.

4. An electric heating unit as defined in claim 1 wherein the surface of the bottom-forming member exposed from the heat-insulating main body and facing the heating element is provided by a highly emissive material or highly reflecting material.

5. An electric heating unit as defined in claim 1, wherein the surface of the bottom-forming member toward the groove opening is made uneven, and the uneven surface has a protrudent portion partly in contact with the heating element.

6. An electric heating unit as defined in claim 5 wherein the surface of the bottom-forming member toward the groove opening is formed, except at widthwise opposite sides thereof, with a furrow extending longitudinally of the groove and is thereby made uneven.

7. An electric heating unit as defined in claim 5 wherein the surface of the bottom-forming member toward the groove opening is formed on a widthwise central portion thereof with a ridge extending longitudinally of the groove and is thereby made uneven.

8. An electric heating unit as defined in claim 1, wherein the bottom-forming member is provided at widthwise opposite sides thereof with heating element support portions supported respectively by the groove-defining opposite side walls integrally therewith and having recessed faces opposed to each other widthwise of the groove, and the bent portions of the heating element are in contact with and supported by the recessed faces.

9. An electric heating unit as defined in claim 6 wherein the furrow is formed at a widthwise central portion of a bottom thereof with projections for gripping a widthwise central portion of the heating element.

10. An electric heating unit as defined in claim 6 wherein exposed portions of the heating element within the groove are made protrudent to project into the furrow of the bottom-forming member.

11. An electric heating unit as defined in claim 1, wherein at least one heating element is spaced apart from the heating element, which is in contact with the bottom-forming member, toward the groove opening by refractory spacers supported by the respective groove-defining opposite side walls integrally therewith, and these heating elements are spaced apart depthwise of the groove.

12. An electric heating unit produced by vacuum molding and comprising a heat-insulating molded body consisting mainly of ceramic fibers and formed with a groove in a surface thereof, and a heating element shaped in the form of waves and supported as provided in the groove by the molded body integrally therewith, the electric heating unit being characterized in that the molded body is caused to support a bottom-forming member of refractory material and the heating element thereon integrally therewith by disposing the bottom-forming member on the heating element in contact with portions of the element and out of contact with a groove-forming ridge portion provided or placed in position within a vacuum mold, the heating element being shaped in the form of waves and disposed along the ridge portion so as to be at least partly in contact with the ridge portion, the bottom-forming member being externally so dimensioned in section orthogonal to the ridge portion as to cover a portion of the heating element included in the amplitude of waveform of the element and approximately corresponding to the width of the ridge portion, and subjecting the resulting arrangement to a vacuum molding operation.

13. A method of producing by vacuum molding an electric heating unit comprising a heat-insulating molded body consisting mainly of ceramic fibers and formed with a groove in a surface thereof, and a heating element shaped in the form of waves and supported as provided in the groove by the molded body integrally therewith, the method being characterized by disposing the heating element shaped in the form of waves along a groove-forming ridge portion provided or placed in position within a vacuum mold so as to be at least partly in contact with the ridge portion, disposing a bottom-forming member of refractory material on the heating element in contact with portions of the element and out of contact with the ridge portion, the bottom-forming member being externally so dimensioned in section orthogonal to the ridge portion as to cover a portion of the heating element included in the amplitude of waveform of the element and approximately corresponding to the width of the ridge portion, and subjecting the resulting arrangement to a vacuum molding operation to prepare a heat-insulating molded body integrally with the bottom-forming member and the heating element.

* * * * *